US008714271B2

(12) United States Patent
Lehr et al.

(10) Patent No.: US 8,714,271 B2
(45) Date of Patent: May 6, 2014

(54) MULTI-PURPOSE FILL AND CIRCULATE WELL TOOL

(75) Inventors: Douglas Julius Lehr, The Woodlands, TX (US); Malcolm Gray-Stephens, Aberdeen (GB); Gareth D. Sonnier, Broussard, LA (US); David H. Harris, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 343 days.

(21) Appl. No.: 13/235,132

(22) Filed: Sep. 16, 2011

(65) Prior Publication Data

US 2012/0073832 A1 Mar. 29, 2012

Related U.S. Application Data

(60) Provisional application No. 61/384,210, filed on Sep. 17, 2010.

(51) Int. Cl.
*E21B 19/18* (2006.01)

(52) U.S. Cl.
USPC ..... 166/382; 166/90.1

(58) Field of Classification Search
USPC ..... 166/382, 77.1, 90.1
See application file for complete search history.

(56) References Cited

U.S. PATENT DOCUMENTS

| | | | | |
|---|---|---|---|---|
| 2,606,618 | A | 8/1952 | Page | |
| 2,764,243 | A | 9/1956 | Page | |
| 3,364,996 | A * | 1/1968 | Brown | 166/120 |
| 6,431,626 | B1 * | 8/2002 | Bouligny | 294/86.25 |
| 7,077,212 | B2 * | 7/2006 | Roesner et al. | 166/382 |
| 2008/0059073 | A1 | 3/2008 | Giroux et al. | |
| 2009/0078407 | A1 | 3/2009 | Carro | |

FOREIGN PATENT DOCUMENTS

| | | |
|---|---|---|
| WO | WO2005090740 A | 9/2005 |
| WO | WO2007035745 | 3/2007 |

OTHER PUBLICATIONS

International Search Report and Written Opinion dated Dec. 20, 2012 and issued in PCT/US2011/52035.

* cited by examiner

*Primary Examiner* — William P Neuder
(74) *Attorney, Agent, or Firm* — Parsons Behle & Latimer

(57) ABSTRACT

A FAC tool for use in a well comprising a well casing. The FAC tool comprises a top drive connection for coupling the tool to a top drive; a push plate; a telescoping section coupling the push plate to the top drive connection; a packer cup configured to seal an annular space between the FAC tool and the well casing when the packer cup is energized; a packer element system comprising at least one packer moveable between a locked position in which the at least one packer is not energized, and an energized position, the packer element system being configured to seal the annular space between the FAC tool and the well casing when in the energized position; and a slip system comprising at least one slip, the slip system configured to lock the packer element in the energized position.

22 Claims, 3 Drawing Sheets

MULTI-PURPOSE FILL AND CIRCULATE WELL TOOL

The present disclosure claims priority to U.S. Provisional Patent Application No. 61/384,210, filed on Sep. 17, 2010, the disclosure of which is hereby incorporated by reference in its entirety.

BACKGROUND OF THE DISCLOSURE

1. Field of the Disclosure

The present disclosure relates generally to a multi-purpose fill and circulate tool ("FAC tool") for use in wells, and more specifically, to a FAC tool comprising a packing element system for use during high pressure events.

2. Description of the Related Art

The process of drilling subterranean wells to recover oil and gas from hydrocarbon reservoirs includes drilling a hole in the earth down to the petroleum accumulation and installing pipe from the reservoir to the surface. A casing is used as a protective pipe liner within the wellbore. The casing can be run into the well bore one section at a time. On occasion, the casing becomes stuck and is unable to be lowered into the wellbore. When this occurs, it is common practice to increase the load on the casing string to force the casing into the wellbore, or drilling fluid can be circulated down the inside diameter of the casing and out of the casing into the annulus in order to free the casing from the wellbore. To accomplish this, it has traditionally been the case that special rigging be installed to add axial load to the casing string and/or to facilitate circulating the drilling fluid. For example, a top drive unit that can apply both torque and mechanical load can be employed to force the casing into the wellbore.

When running casing, drilling fluid is generally added to each section as it is run into the well. This procedure is performed to prevent the casing from collapsing due to high pressures within the wellbore. The drilling fluid can also act as a lubricant to facilitate lowering the casing within the wellbore. The drilling fluid is often circulated in the casing and well bore when resistance is experienced as the casing is lowered into the wellbore. In order to circulate the drilling fluid, the top of the casing is sealed so that the casing may be pressurized.

It is well known in the art to employ a FAC tool to seal the top of the casing when adding the drilling fluid to the wellbore. The FAC tool is inserted into the top of the casing as it is run into the well. A top drive unit connects to the top end of the FAC tool and is used to drive the FAC tool and casing into the well. Drilling fluid, such as drilling mud, is injected into the well casing through an axial flowpath in the FAC tool. The FAC tool generally includes packing elements, such as a packer cup, which provides a low pressure seal between the FAC tool and the casing. This can prevent or at least reduce the amount of drilling fluid that is spilled from the top of the casing, and allows the casing to be pressurized to circulate the drilling fluid.

During the running of the casing into the wellbore, pressures experienced by the FAC tool are generally relatively low, (e.g., less than about 1000 psi). However, periodically well pressures can increase to over 1000 psi, such as 5,000 psi or more. When this occurs, the high pressure on the FAC tool is too great for the low pressure seal, and may cause excessive leakage of the drilling fluid from the wellbore, which can be costly and harmful to both the environment and to well rig operators. In some cases a high pressure event can push the FAC tool right out of the wellbore, potentially causing damage to the FAC tool or drilling rig or harm to the drill rig operators.

When a high pressure event is sensed, the well rig operators will generally follow a set of safety protocols that can reduce the risk of harm caused by the event. However, the amount of time between when the high pressure event is sensed and the point at which the packer cup on the FAC tool fails can be relatively short. In some cases, well operators may not have sufficient time to carry out the appropriate safety protocols before damage occurs.

The present disclosure is directed to overcoming, or at least reducing the effects of one or more of the issues set forth above.

SUMMARY OF THE DISCLOSURE

An embodiment of the present disclosure is directed to a FAC tool for use in a well comprising a well casing. The FAC tool comprises a top drive connection for coupling the tool to a top drive; a push plate; a telescoping section coupling the push plate to the top drive connection; a packer cup configured to seal an annular space between the FAC tool and the well casing when the packer cup is energized; a packer element system comprising at least one packer moveable between a locked position in which the at least one packer is not energized, and an energized position, the packer element system being configured to seal the annular space between the FAC tool and the well casing when in the energized position; and a slip system comprising at least one slip, the slip system configured to lock the packer element in the energized position.

Another embodiment of the present disclosure is directed to a method for operating a FAC tool engaged in a well casing of a well. The FAC tool comprises a top drive connection for coupling the tool to a top drive; a push plate; a packer cup configured to seal an annular space between the FAC tool and the well casing when the packer cup is energized; a packer element system comprising at least one packer moveable between a locked position in which the at least one packer is not energized, and an energized position, the packer element system being configured to seal the annular space between the FAC tool and the well casing when in the energized position; and a slip system comprising at least one slip, the slip system configured to lock the packer element in the energized position; wherein the method comprises: sensing a high pressure event; unlocking the packer element system; moving the at least one packer to the energized position; and deploying the at least one slip to lock the at least one packer in the energized position.

Yet another embodiment of the present disclosure is directed to a method for operating a multi-purpose fill and circulate tool ("FAC tool") engaged in a well casing of a well. The method comprises sensing a high pressure event, unlocking a packer element system of the FAC tool, the packer element system comprising at least one packer; moving the at least one packer to an energized position; and deploying at least one slip to secure the FAC tool in the casing, the slip system retaining the at least one packer in the energized position.

Figure 1:
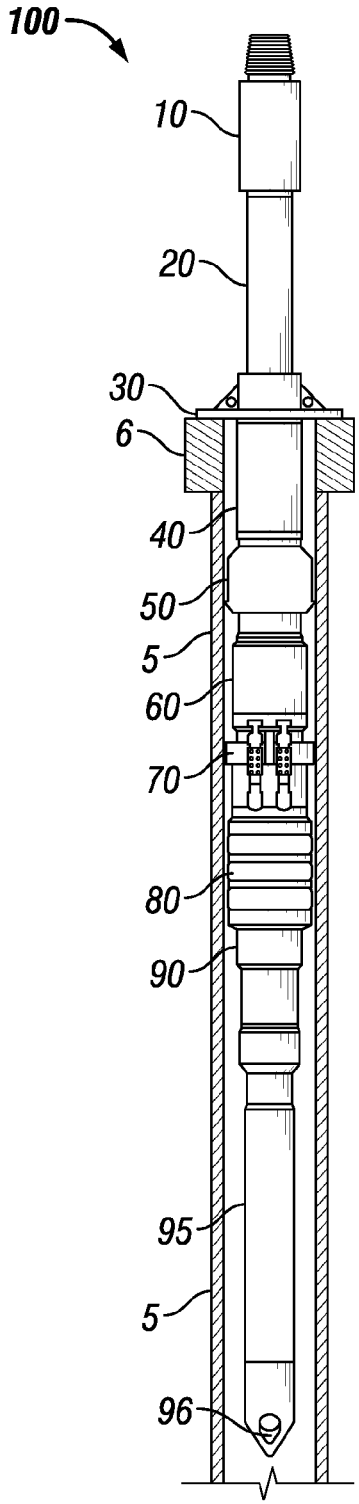
FIG. 1 illustrates a schematic drawing of a FAC tool, according to an embodiment of the present disclosure.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the disclosure as defined by the appended claims.

DETAILED DESCRIPTION

FIG. 1 shows one embodiment of a multipurpose FAC tool 100 positioned within a segment of casing 5. As discussed above, the FAC tool 100 is positioned into the upper most section of casing as the casing section 5 is run into the wellbore. The FAC tool 100 provides for a pathway for the injection of fluids, such as drilling mud, into the casing 5 positioned into the wellbore. Drilling mud is pumped into the casing string to help prevent failure of the casing due to the hydrostatic pressure within the wellbore outside of the casing string. The casing string includes a float shoe (not shown) located at the bottom section of the casing string. The float shoe includes a valve, such as a check valve, that prevents the flow of wellbore fluids into the casing string.

The FAC tool 100 may be connected to the uphole end of a casing section 5 that is run into the wellbore. The FAC tool 100 is inserted into the uphole end of the casing section 5 until a push plate 30 is positioned against a casing collar, or casing joint, 6. The casing collar 6 provides a connection for the next section of casing 5 to be inserted into the wellbore. The push plate 30 is adapted to prevent the complete insertion of the FAC tool 100 into the bore of the casing string.

The push plate 30 is connected to a telescoping section 20 that extends above the push plate 30 to a connector 10 adapted to connect to a top drive (not shown). The telescoping section 20 extends through, and is movable with respect to, the push plate 30. The top drive may be used to rotate and insert the casing string during insertion into the wellbore. The weight of a typical top drive, which may be between 40,000 lbs and 120,000 lbs for example, is typically sufficient to retain the FAC tool 100 within the bore of the casing segment 5 when ordinary pressure exists within the bore, which may be between 100 psi and 500 psi and generally does not exceed 1,000 psi.

The FAC tool 100 includes a packing element 50, which generally may be a cup type packing element. Drilling mud may be pumped down through the bore of the FAC tool 100 and out of a port 96 of a mudsaver valve assembly 95, which includes a check valve (not shown) that prevents flow of fluids up through the bore of the FAC tool 100. The packing element 50 engages the inner bore of the casing segment 5, thereby providing a seal that prevents the flow of drilling mud and/or fluid up the annulus between the FAC tool 100 and the inner bore of the casing 5. The packing element 50 is typically sufficient to seal against the casing 5 unless the pressure within the casing string increases above normal amounts, such as 500 psi.

In the event that the valve in the float shoe fails or a portion of the casing fails, the pressure within the bore of the casing string may increase above normal amounts, such as 500 psi to 1000 psi, exerting a large force upon the FAC tool 100 inserted into the top end of the casing string. The upward force exerted against the FAC tool 100 may exceed the weight of the top drive being used to retain the FAC tool 100 within the casing segment 5. For example, a pressure of 5000 psi within the 12½ inch bore of 13⅜ inch casing may exert a force on the FAC tool 100 that exceeds 500,000 lbs. In this instance, the weight of the top drive is not sufficient to retain the FAC tool 100 within the bore of the casing segment 5. Further, the typical sealing element 50, such as a cup type sealing element, used on FAC tools cannot withstand pressures within the casing string that exceed approximately 1000 psi. Failure of the sealing element 50 permits fluids within the casing string, such as drilling mud and wellbore fluids, to flow past the sealing element 50 and out of the casing string.

The embodiment of FAC tool 100 shown in FIG. 1 includes components to reduce or prevent the flow of fluids out of the casing segment and to retain the FAC tool 100 within the casing segment in the instance of elevated pressures within the casing string due to failure of the float shoe and/or the failure of a casing segment within the wellbore. The FAC tool 100 includes a packing element(s) 80 that is adapted to provide a seal against the inner diameter of the casing segment at increased pressures of above 1000 psi, such as 6,500 psi, or 10,000 psi or more. One or more packing elements can be employed, such as two, three or more packing elements. The packing element 80 may be a service packer type that may be energized upon the application of a set down weight as described below. In an embodiment, the packing element may be unlocked upon rotation of the top drive prior to energizing the packer. The packing element 80 is adapted to provide a seal between the FAC tool 100 and casing 5 at elevated pressures in the casing string potentially due to failure, as discussed above.

The FAC tool 100 includes a slip system 70 that may be actuated to retain the FAC tool 100 at a set position with the casing segment 5. The slip system 70 is used to retain the FAC tool 100 at this position to ensure that the packing element 80 remains energized. The slip system 70 may include conventional slips and cones used to set a tool within casing and/or tubing as would be appreciated by one of ordinary skill in the art having the benefit of this disclosure. In an embodiment, the slips are biased, such as with a spring, so as to be forced into a position to lock the packer element 80 in an energized position when the load on the FAC tool is increased. The use of the packing element 80 and slip system 70 may be used together to prevent fluid flow up past the FAC tool 100 and retain the FAC tool 100 within casing 5 when elevated pressures exist within the casing string.

Figure 2:
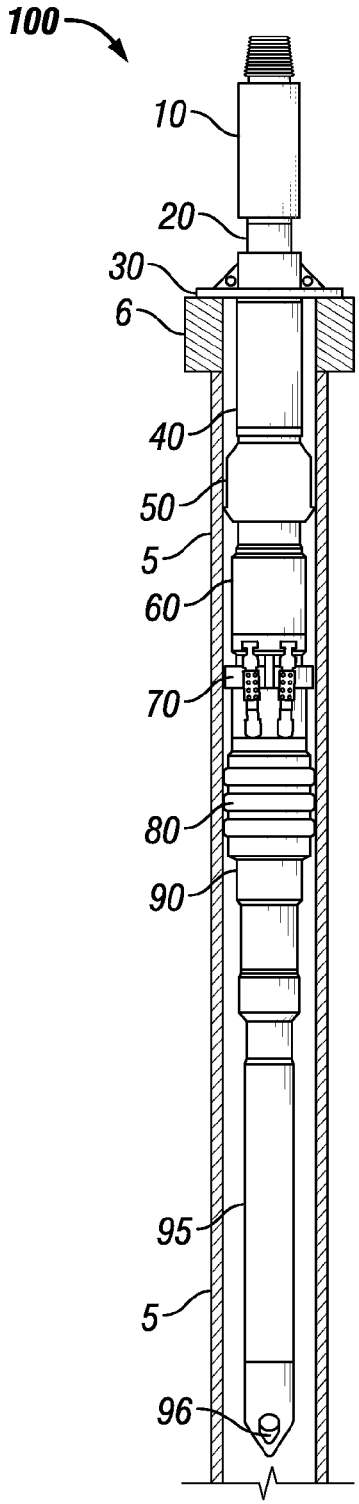
FIG. 2 illustrates a schematic drawing of the FAC tool of FIG. 1 in which a packing element system has been energized, according to an embodiment of the present disclosure.

To minimize wear and tear of the packing element 80 and/or slip system 70, these components may be locked and not actuated during normal filling operations of the FAC tool 100. When an increase in pressure is observed, the operator may unlock the components to prevent failure of the seal and/or blow out of the FAC tool 100. One embodiment of the present disclosure is a method to unlock and actuate the high pressure elements of the FAC tool 100. FIG. 2 shows the FAC tool 100 with the packing element 80 actuated and the slip system 70 engaging the casing 5.

To unlock the components, the top drive weight is slacked off against the push plate 30 and the casing collar 6. The amount of weight slacked off may be adapted based on the various design of the FAC tool 100. For example the weight slacked off may range from about 10,000 to about 20,000 lbs. The components may then be unlocked by rotation of the FAC tool 100. An upper control section 40 of the FAC tool 100 may include a structure that facilitates the unlocking of the packing element 80 and slip system 70. The structure located in the upper control section 40 may be, for example, a J-slot system or course thread, as would be appreciated by one of ordinary skill in the art having the benefit of this disclosure. The number of rotations needed to unlock the components as well as the rotation direction may be varied as desired to unlock the components. Such control sections are generally well known in the art.

Once unlocked, a slack-off weight may then be applied to the FAC tool 100. In an embodiment, the weight of a top drive can be used to shear a device 72, such as a shear ring or screw, as in an embodiment illustrated in FIG. 4. This allows the weight from the top drive to force the telescoping section 20 downward to energize the packing element 80 against the inner bore of the casing 5, thereby providing a higher pressure seal than the cup sealing element 50.

FIG. 2 shows the packing element 80 of FAC tool 100 in an energized state against the casing 5. The slack-off weight will cause the downward travel of the FAC tool 100 to energize the packing element 80. Once the packing element 80 is energized, the operator can set the slip system 70 against the casing 5 to retain the FAC tool 100 in this position, thereby allowing the packing element 80 to remain energized. Alternatively, the slip system may be actuated simultaneously with energizing the packing system. The slip system 70 may be set by the rotation of the FAC tool 100. For example, the FAC tool 100 can be rotated in the direction opposite of the direction rotated to unlock the high pressure components. A middle control section 60 of the FAC tool 100 may include the components used to set the slip system 80 against the casing 5. For example, the rotation of the middle section 60 may force the slips to travel along the cone ramps causing the slips to expand outwards and engage the casing 5 as would be appreciated by one of ordinary skill in the art.

After the slip system 70 has engaged the casing, the FAC tool 100 may include a lower control section 90 that may be actuated to lock the FAC tool 100 and prevent further rotation and/or movement of the telescoping section 20 of the FAC tool 100. To lock down the FAC tool 100, the top drive may be rotated and moved downward, causing the telescoping section 20 to rotate through a J-slot system located in the lower control section 90, thereby locking down and preventing accidental release of the FAC tool 100. The repeated rotation and downward movement of the telescoping section 20 of the FAC tool 100 results in a decrease in the distance between the push plate 30 and top drive connector 10, as shown in FIG. 2.

Alternatively, rather than employing an upper, middle and lower control sections, as described above, the FAC tool could be designed to have only a single control section. The single control section could perform all the functions of the upper, middle and lower control sections (e.g., unlock the components, set the slip system 80 against the casing 5, and lock the FAC tool 100, as described above). Such control systems are well known.

After the high pressure event has been controlled, the operator may desire to remove the locked down FAC tool 100. To remove the locked down FAC tool 100, one method may reverse rotation of the FAC tool to move out of the J-slot system in the lower control section 90 to unlock the telescoping section 20 of the FAC tool 100. Once unlocked, a top drive weight may be applied to shear release the FAC tool 100 (a shear down mechanism). A straight pull up on the FAC tool 100 can be employed to stretch out the tool and de-energize the packer element 80 and release the slip system 70 from casing 5, thereby permitting the FAC tool 100 to be removed from the casing. Alternative types of releases could include a shear up mechanism or other mechanism that employs a movement that does not involve rotation or a J-slot to unlock and/or release. Still other releasing means could include unscrewing out of large acme thread or other thread profile.

Figure 3:
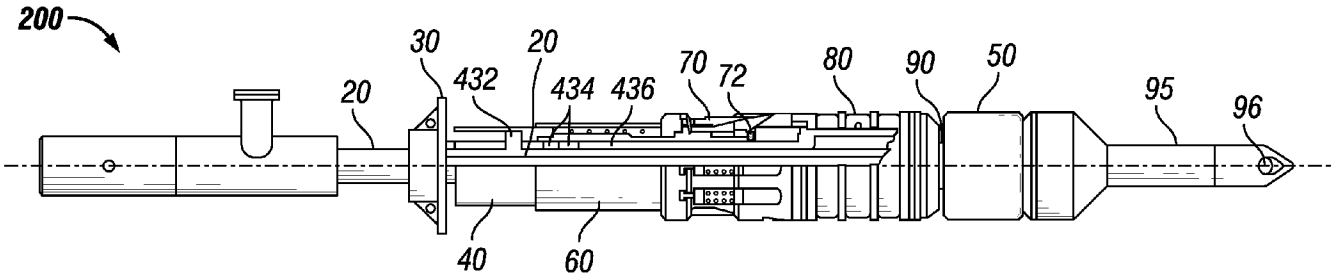
FIG. 3 illustrates a schematic view of a FAC tool positioned for running in hole, according to an embodiment of the present disclosure.
Figure 4:
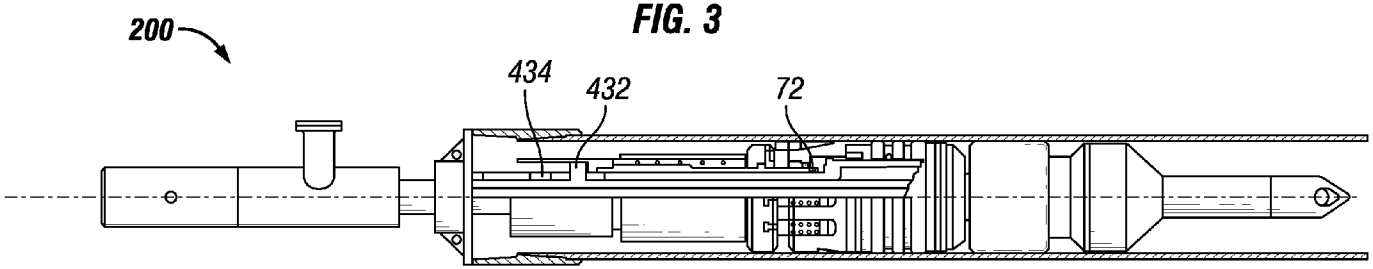
FIG. 4 illustrates a schematic view of the FAC tool of FIG. 3 with high pressure components activated, according to an embodiment of the present disclosure.
Figure 5:
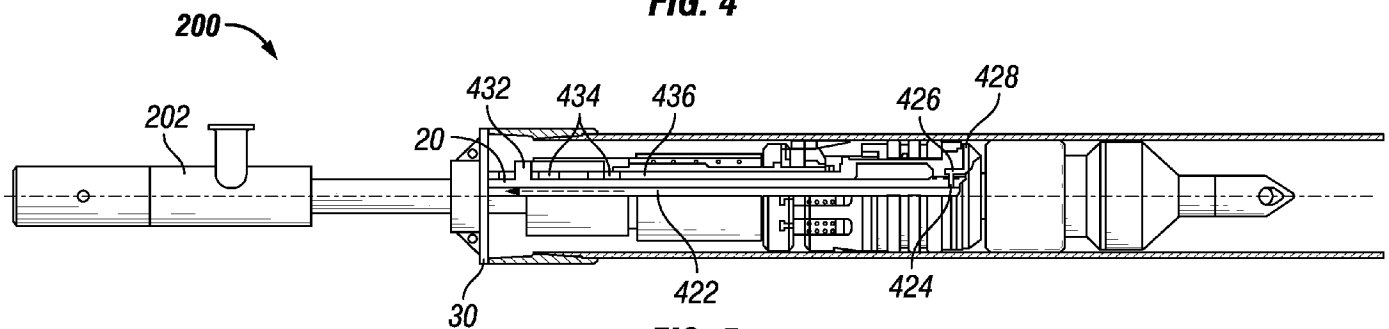
FIG. 5 illustrates a schematic view of the FAC tool of FIG. 3 in a flowback position, according to an embodiment of the present disclosure.
Figure 6:
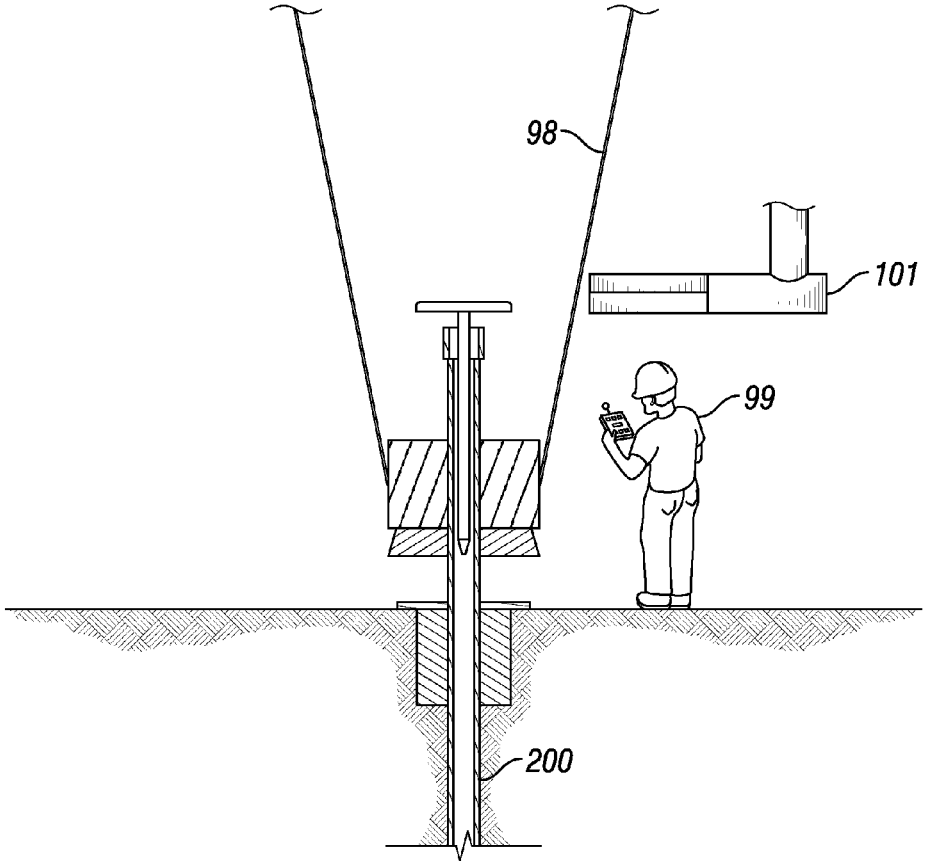
FIG. 6 illustrates a schematic view of a FAC tool coupled to a top drive during a run-in operation, according to an embodiment of the present disclosure.

Another embodiment of a FAC tool 200 is illustrated in FIGS. 3 to 5. FIG. 3 illustrates a view of the FAC tool 200 positioned for running in a hole. During run-in operations, the FAC tool 200 can be coupled to the bottom of a top drive 98, as illustrated in FIG. 6. When the FAC tool 200 is run into the well, the RSP components (e.g., slip mechanism, packing elements) are locked, similarly as described above for FAC tool 100.

FAC tool 200 includes a telescoping section 20, a push plate 30, a slip system 70 and packing element(s) 80, similarly as described in the above embodiment. A packer cup 50 is positioned over the lower control system (not shown in FIG. 3) and below packing element system 80. A mudsaver valve assembly 95 and port 96 are also included, similar to the FAC tool 100. In an embodiment, the length of the mudsaver valve assembly 95 can be reduced compared to the mudsaver valve assembly 95 in FIG. 1.

By positioning the packer cup 50 over the lower control system and reducing the length of the mudsaver valve assembly 95, the total length of the FAC tool 200 can be reduced. For example, the length may be reduced by 20% to 30% or more relative to FAC tool 100. By reducing the length of FAC tool 200 relative to FAC tool 100, a person 99 on the rig floor will not have to be as high in the air to operate the power tongs 101 of the rig. See FIG. 6. As is well known, the power tongs 101 are used to rotate each joint of casing and make it up into the joint of casing that was just run through the drill floor.

In the ordinary course of operating FAC tool 200, the tool is repeatedly stabbed into joints of casing. Because the packing element 50 is positioned below the packing elements 80, it may be possible to stab only a lower portion (e.g., about 25 to about 30% of the length) of the FAC tool into the casing, so that the FAC tool extends into the casing just far enough to get packer cup 50 to seal. Inserting the packer cup 50 without inserting the packing elements 80 can provide sufficient protection in a typical operation where a well control event is not occurring. In addition, wear and tear caused by rubbing/dragging on the packing element system 80 and the slip system may be reduced.

The one or more packing elements 80 may be a service packer type that may be energized upon the application of a set down weight as described above with respect to FAC tool 100. FIG. 4 illustrates the FAC tool 200 with the packing elements 80 in the energized position with the slip system 70 set.

In an embodiment, the FAC tools of the present application include a flowback position. FIG. 5 illustrates a flowback position for the FAC tool 200. The flow back position allows flow from the well to be released through the flow cross 202 to relieve pressure from below. Alternatively, fluid can be pumped in through the flow cross 202 and down through the mudsaver valve assembly 95.

The flowback position allows the flow to bypass the check valve in the mudsaver valve assembly 95. After the high pressure components have been energized, the telescoping section 20 can be adjusted to a position that allows fluid to bypass the check valve and come up through a flowback path 422 to the surface. In an embodiment, the telescoping section 20 can include a port 424 that is capable of aligning with a flowback conduit 426 that is in fluid connection with the wellbore below the packing elements 80 via a port 428. When the telescoping section 20 is positioned to align the port 424 with the flowback conduit 426, high pressure fluids beneath the FAC tool can bypass the mudsaver valve and flow up to the surface through the port 428, the flowback conduit 426 and the flowback path 422. Any other suitable configuration that is capable of providing flow of high pressure fluids from beneath the FAC tool could be employed in place of the flowback configuration illustrated.

Figure 7:
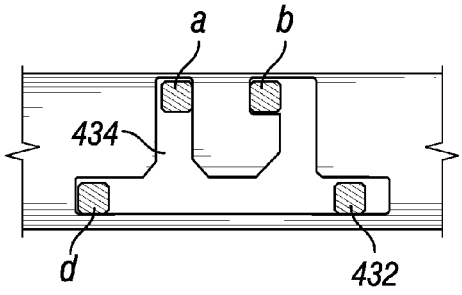
FIGS. 7 and 8 illustrate a plan view of J-slot system positions, according to embodiments of the present disclosure.
Figure 8:
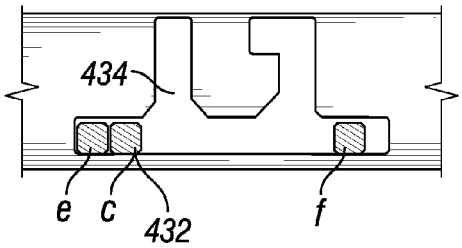

FIGS. 7 and 8 illustrate plan views of examples of J-slot positions for an embodiment where a J-slot system is employed. The J-slot system can include a lug 432 positioned on the telescoping section 20. The lug 432 can traverse a track 434 that is configured to place the components of the FAC tool in various desired positions, including: position *a*, which is the run-in-position as shown in FIGS. 3 and 7; position *b*, in which the high pressure components are activated as shown in FIGS. 4 and 7; position *c*, which is the flowback position as shown in FIGS. 5 and 8; and *a*position *d*(as shown in FIG. 7), in which the high pressure components are unlocked and ready for retrieval. In an embodiment, the J-slot system can include a shear up position, *e*, and/or a shear down position, *f*, (shown in FIG. 8) in which upward or downward forces, respectively, can be applied to shear a release mechanism that can allow the tool to be released from the wellbore. Such shear release mechanisms are well known in the art.

The track 434 of the J-slot system can be positioned in or connected to a mandrel 436 that is attached to the push plate 30. The mandrel 436 can be attached to the push plate in any suitable manner, such as by welding or by threading it onto the push plate 30. The lug 432 can traverse the track 434 of the mandrel 436 to move the FAC tool between the various positions as illustrated in FIGS. 3 to 5 and 7 to 8.

Although various embodiments have been shown and described, the present disclosure is not so limited and will be understood to include all such modifications and variations as would be apparent to one skilled in the art.

What is claimed is:

1. A multi-purpose fill and circulate tool ("FAC tool") for use in a well comprising a well casing, the FAC tool comprising:

a top drive connection for coupling the tool to a top drive;

a packer cup configured to seal an annular space between the FAC tool and the well casing when the packer cup is energized;

a packer element system comprising at least one packer moveable between a locked position in which the at least one packer is not energized, and an energized position, the packer element system being configured to seal the annular space between the FAC tool and the well casing when in the energized position; and a slip system comprising at least one slip positioned between the packer cup and the packer element system, the slip system configured to secure the FAC tool in the casing, the slip system configured to retain the at least one packer in the energized position.

2. The tool of claim 1, further comprising a push plate; and a telescoping section coupling the push plate to the top drive connection.

3. The tool of claim 1, further comprising a lower valve assembly positioned below the packer element system.

4. The tool of claim 1, wherein the FAC tool comprising an inner flow path extending from the top drive connection through the lower valve assembly, thereby allowing fluid to flow through the FAC tool and into the well.

5. The tool of claim 1, wherein an upper control section is positioned between the push plate and the packer cup.

6. The tool of claim 1, wherein a middle control section is positioned between the packer cup and the slip system.

7. The tool of claim 1, wherein a lower control section is positioned between the packing element system and the valve assembly.

8. The tool of claim 1, wherein the packing element system comprises a plurality of packers.

9. The tool of claim 1, wherein the packer cup is positioned below the packing element system.

10. The tool of claim 1, further comprising a flowback path that is configured to allow fluid to be released from the well below the packers of the packing element system when the packing element system is energized.

11. A method for operating a multi-purpose fill and circulate tool ("FAC tool") engaged in a well casing of a well, the FAC tool comprising:

a top drive connection for coupling the tool to a top drive;

a push plate;

a packer cup configured to seal an annular space between the FAC tool and the well casing when the packer cup is energized;

a packer element system comprising at least one packer moveable between a locked position in which the at least one packer is not energized, and an energized position, the packer element system being configured to seal the annular space between the FAC tool and the well casing when in the energized position; and a slip system comprising at least one slip, the slip system configured to secure the FAC tool in the casing, wherein the method comprises:

sensing a high pressure event;

unlocking the packer element system;

moving the at least one packer to the energized position; and deploying the at least one slip to secure the FAC tool in the casing, the slip system retaining the at least one packer in the energized position.

12. The method of claim 11, wherein an upper control section is positioned between the push plate and the packer cup.

13. The method of claim 11, wherein a middle control section is positioned between the packer cup and the slip system.

14. The method of claim 11, wherein a lower control section is positioned between the packing element system and the valve assembly.

15. The method of claim 11, wherein the packing element system comprises a plurality of packers.

16. The method of claim 11, wherein unlocking the packer comprises reducing a load on, and rotating of, the FAC tool.

17. The method of claim 11, wherein moving the at least one packer to the energized position comprises increasing a load on the FAC tool.

18. The method of claim 17, wherein the slips are biased so as to be forced into a position to secure the FAC Tool in the casing when the load on the FAC tool is increased.

19. The method of claim 11, further comprising locking a telescoping section of the FAC tool after deploying the at least one slip.

20. The method of claim 11, further comprising removing the FAC tool from the casing.

21. The method of claim 11, further comprising adjusting the FAC tool to a flowback position to allow fluid to be released from the well below the packers of the packing element system when the packing element system is energized.

22. A method for operating a multi-purpose fill and circulate tool ("FAC tool") engaged in a well casing of a well, the method comprising:

sensing a high pressure event;

unlocking a packer element system of the FAC tool, the packer element system comprising at least one packer;

moving the at least one packer to an energized position; and deploying at least one slip to secure the FAC tool in the casing, the slip system retaining the at least one packer in the energized position.

* * * * *